US011454248B1

(12) United States Patent
Gessler

(10) Patent No.: US 11,454,248 B1
(45) Date of Patent: Sep. 27, 2022

(54) TRANSPARENT SUMP PUMP TANK COVER

(71) Applicant: Ellen M. Gessler, Tomahawk, WI (US)

(72) Inventor: Ellen M. Gessler, Tomahawk, WI (US)

( * ) Notice: Subject to any disclaimer, the term of this patent is extended or adjusted under 35 U.S.C. 154(b) by 0 days.

(21) Appl. No.: 17/400,850

(22) Filed: Aug. 12, 2021

Related U.S. Application Data

(60) Provisional application No. 63/224,687, filed on Jul. 22, 2021.

(51) Int. Cl.

| | |
|---|---|
| ***F04D 13/08*** | (2006.01) |
| ***F04D 29/40*** | (2006.01) |
| *F04D 29/08* | (2006.01) |
| *F04D 13/16* | (2006.01) |
| *F04D 29/62* | (2006.01) |
| *F04D 13/06* | (2006.01) |
| *F04D 29/60* | (2006.01) |

(52) U.S. Cl.
CPC ..... *F04D 29/406* (2013.01); *F04D 13/086* (2013.01); *F04D 13/0693* (2013.01); *F04D 13/16* (2013.01); *F04D 29/086* (2013.01); *F04D 29/606* (2013.01); *F04D 29/628* (2013.01)

(58) Field of Classification Search
CPC ..... F04D 29/406; F04D 29/007; F04D 29/026
USPC ..... 137/565.37, 371
See application file for complete search history.

(56) References Cited

U.S. PATENT DOCUMENTS 3,558,018 A * 1/1971 Hudig ..... F04D 9/041 417/86
4,228,427 A 10/1980 Niedermeyer
D364,210 S 11/1995 Loerop et al.
5,567,127 A * 10/1996 Wentz ..... A47L 7/00 415/119
6,164,315 A * 12/2000 Haslock ..... E03F 5/22 137/271
7,264,449 B1 * 9/2007 Harned ..... F04D 15/0218 417/366
8,051,873 B2 * 11/2011 Mullen ..... E03F 5/22 137/371
8,529,228 B1 9/2013 Thompson
2004/0094209 A1 * 5/2004 Harwood ..... E02D 31/02 137/565.29
2005/0034383 A1 2/2005 Allen
2006/0093492 A1 * 5/2006 Janesky ..... F04D 29/708 417/366

(Continued)

*Primary Examiner* — Nathan C Zollinger
*Assistant Examiner* — Timothy P Solak
(74) *Attorney, Agent, or Firm* — Boudwin Intellectual Property; Daniel Boudwin

(57) ABSTRACT

A transparent sump pump tank cover configured to seal overtop a sump pump tank, hole, pit, or reservoir includes a transparent material making up the body of the cover. A pair of apertures are disposed on the cover. The pair of apertures extended through the cover and are configured to receive pipes therethrough. A third aperture is disposed on the cover. The third aperture extends through the cover and configured to receive electrical cords therethrough. A fourth aperture may be disposed on the cover. The fourth aperture extends through the cover and is configured to receive a vacuum hose for removing fluid from the sump pump tank, hole, pit, or reservoir. The transparent sump pump tank cover allows individuals to visually inspect the sump pump system for faults and easily remove fluid for further inspection without removing the cover.

9 Claims, 2 Drawing Sheets

(56) References Cited

U.S. PATENT DOCUMENTS

| | | | | |
|---|---|---|---|---|
| 2009/0053073 | A1* | 2/2009 | Ward | F04D 29/708<br>417/40 |
| 2017/0246567 | A1* | 8/2017 | Mabe, Jr. | B01D 29/925 |

* cited by examiner

TRANSPARENT SUMP PUMP TANK COVER

CROSS REFERENCE TO RELATED APPLICATIONS

This application claims the benefit of U.S. Provisional Application No. 63/224,687, filed on Jul. 22, 2021. The above identified patent application is herein incorporated by reference in its entirety to provide continuity of disclosure.

BACKGROUND OF THE INVENTION

The present invention relates to covers for sump pump tanks and reservoirs. More particularly, the present invention provides a cover for a sump pump or lift pump tank or reservoir that allows an individual to visually inspect the sump pump system without removing the cover.

In buildings and other structures that have structural features positioned lower than the surrounding ground level, fluids may enter the building. In many instances these fluids will need to be pumped in an upward direction to remove them from the structure. This is accomplished with a device known as a lift pump or a sump pump, which take in the fluid and pump it upward and out of the structure. Such devices are used for the displacement of gray water as well as sewage in home and office settings. These pumps are often effective, but sometimes fail during use.

A common problem encountered is when a float of the pump is stuck in a downward position. In this instance, the float fails to rise to signal the pump to turn on and eject the fluid from the sump pump or reservoir containing the sump pump. In such scenarios, the fluid may seep out of the sump pump reservoir or tank and spread through the surrounding environment, such as a basement, family room, bathroom, and the like. Water damage and other issues this causes can be both costly to fix, as well as unsanitary or even dangerous.

Traditional sump pump tank covers are secured in place and are composed of solid, opaque materials. This prevents an individual from easily observing the contents of the sump pump tank or reservoir containing the sump pump. In other words, typical sump pump tank covers prevent individuals from visually inspecting the pump. Many sump pump problems could be avoided if individuals could easily visually inspect the sump pump for malfunction. Further, users can also sometimes remove excess fluid to access the valve for inspection. However, doing so typically requires removal of the sump pump tank cover, which can be time consuming and difficult. If the user is unable to properly reseal the sump pump tank cover, the leakage issues may continue and worsen overtime.

Consequently, there is a need for an improvement in the art of sump pump tank covers. The present invention substantially diverges in design elements from the known art while at the same time solves a problem many people face when needing to inspect their sump pumps in flooded conditions. In this regard the present invention substantially fulfills these needs.

SUMMARY OF THE INVENTION

The present invention provides a transparent sump pump tank cover wherein the same can be utilized for providing convenience for the user when inspecting a sump pump tank or reservoir. The transparent sump pump tank cover includes a body composed of a transparent material, a first pair of apertures disposed on the cover and extending through the body, wherein each aperture of the pair of apertures is configured to receive a pipe therethrough, and a third aperture disposed on the cover and extending through the body, wherein the third aperture is configured to receive one or more electrical cords therethrough. The transparent material allows an individual to inspect the sump pump tank or reservoir for issues without removing the cover.

One object of the transparent sump pump tank cover is to include a fourth aperture extending through the cover that is configured to receive a vacuum hose for emptying liquid from the reservoir without removing the cover.

Another object of the transparent sump pump tank cover is to provide a cover with a plurality of apertures disposed around the perimeter of the cover for securing the cover in place with corresponding fasteners.

A further object of the transparent sump pump tank cover is to provide a cover with rubber gaskets lining each of the pair of apertures, such that a seal is maintained to prevent leaks.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
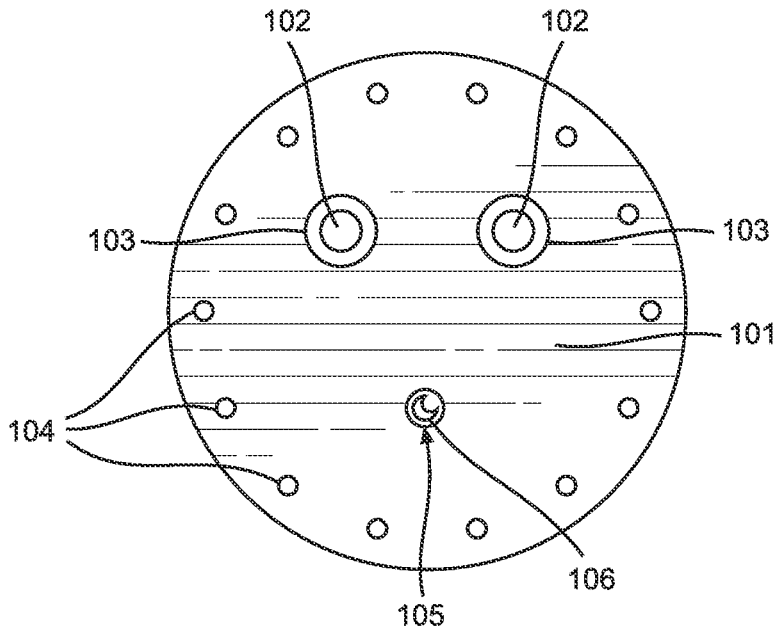
FIG. 1 shows a top plan view of an embodiment of the transparent sump pump tank cover.

Reference is made herein to the attached drawings. Like reference numerals are used throughout the drawings to depict like or similar elements of the transparent sump pump tank cover. For the purposes of presenting a brief and clear description of the present invention, a preferred embodiment will be discussed as used for sealing a sump pump tank while allowing users to visually inspect the tank contents without removing the cover. The figures are intended for representative purposes only and should not be considered to be limiting in any respect.

Referring now to FIG. 1, there is shown a top plan view of an embodiment of the transparent sump pump tank cover. The transparent sump pump tank cover includes a body 101. The body 101 is made from a transparent material. In one embodiment the transparent material is a polycarbonate material, which provides a strong, durable cover that also allows the tank or reservoir interior to be visible, which allows an individual to identify potential problems with the sump pump system without removing the cover. In another embodiment the transparent material is a different type of plastic. In the shown embodiment the transparent sump pump tank cover is circular. However, the present disclosure contemplates any necessary shape to cover a sump pump hole. Further, the terms hole, pit, reservoir, and tank all refer to the area which houses the sump pump and liquid, shown as 302 in FIG. 3.

The body 101 of the transparent sump pump tank cover has a pair of apertures 102. The pair of apertures 102 are configured to receive pipes therethrough (shown in FIG. 3). In the shown embodiment, the pair of apertures 102 are offset from a center midline area of the body 101, to allow maximum visibility through the body 101 into the tank or reservoir. The pair of apertures 102 are proportioned to snuggly receive pipes such that they frictionally engage the apertures 102. In another embodiment the interior edge of each of the pair of apertures 102 have a gasket lining 103. The gasket lining 103 will allow for many different sized pipes to fit within the pair of apertures 102 as it compresses to fit different sized pipes. A further benefit to the gasket lining 103 is to prevent air and associated smells from exiting the area under the cover. The gasket lining 103 further seals the apertures 102 to prevent leaks. The body 101 further has a plurality of fastener apertures 104 located about a perimeter of the body 101. The plurality of fastener apertures 104 are configured to receive fasteners therethrough (shown in FIG. 3). In one embodiment the plurality of fastener apertures 104 are evenly spaced around the perimeter of the body 101 in order to provide a secure connection.

In this embodiment there is a third aperture 105 located on and extending through the body 101. The third aperture 105 is configured to receive fit electrical cords therein. In one embodiment the third aperture 105 has a gasket 106 located therein. In one embodiment the gasket 106 is secured to the body 101. In another embodiment the gasket 106 is removable. In this embodiment the gasket 106 may be placed around an electrical cord then the cord and the gasket 106 will be placed within and secured in the third aperture 105. The gasket 106 seals against the electrical wires to prevent odor and fluid from leaking through the third aperture 105.

Figure 2:
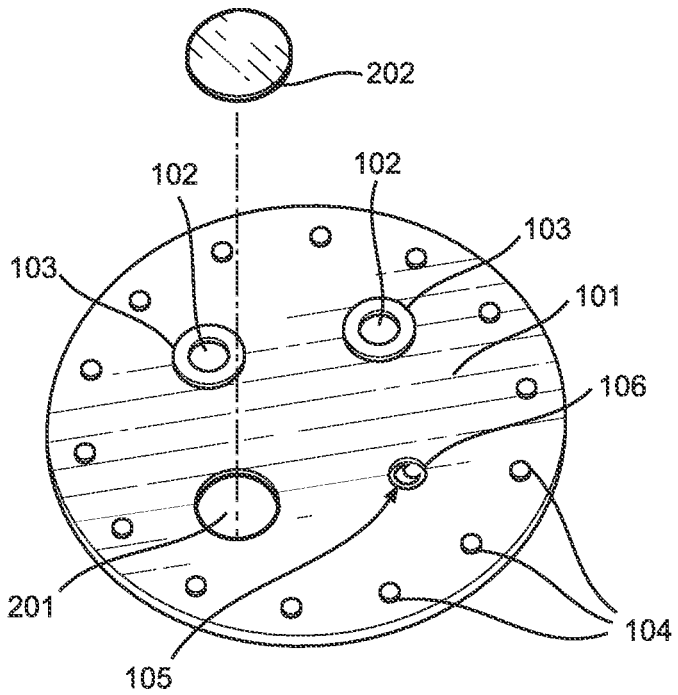
FIG. 2 shows a perspective view of an alternate embodiment of the transparent sump pump tank cover.

Referring now to FIG. 2, there is shown a perspective view of an alternative embodiment of the transparent sump pump tank cover. This alternative embodiment of the transparent sump pump tank cover has similar aspects of the previous embodiment as shown in FIG. 1. This alternative embodiment of the transparent sump pump tank cover further includes a fourth aperture 201 located on and extending through the body 101. In one embodiment, the fourth aperture 201 is configured to receive a vacuum hose therein (shown in FIG. 3). In one embodiment, the fourth aperture 201 has a removable plug 202 that can be used to seal the fourth aperture 201 when the vacuum hose is not in use to prevent fluid and odor from leaking through the fourth aperture 201. The plug 202 is proportioned to be removably secured within the fourth aperture 201 via a friction fit. In one embodiment the plug 202 is a removable rubber plug having a thickness of ¼ inch for sealing the fourth aperture 201. In some embodiments, the fourth aperture 201 includes sealing gaskets similar to the other apertures to maintain a seal when the vacuum hose is inserted through the fourth aperture 201. In the shown embodiment, the four aperture 201 and corresponding plug 202 are three inches in diameter, which allows a typical shop vacuum hose to be insertable through the cover as needed.

Figure 3:
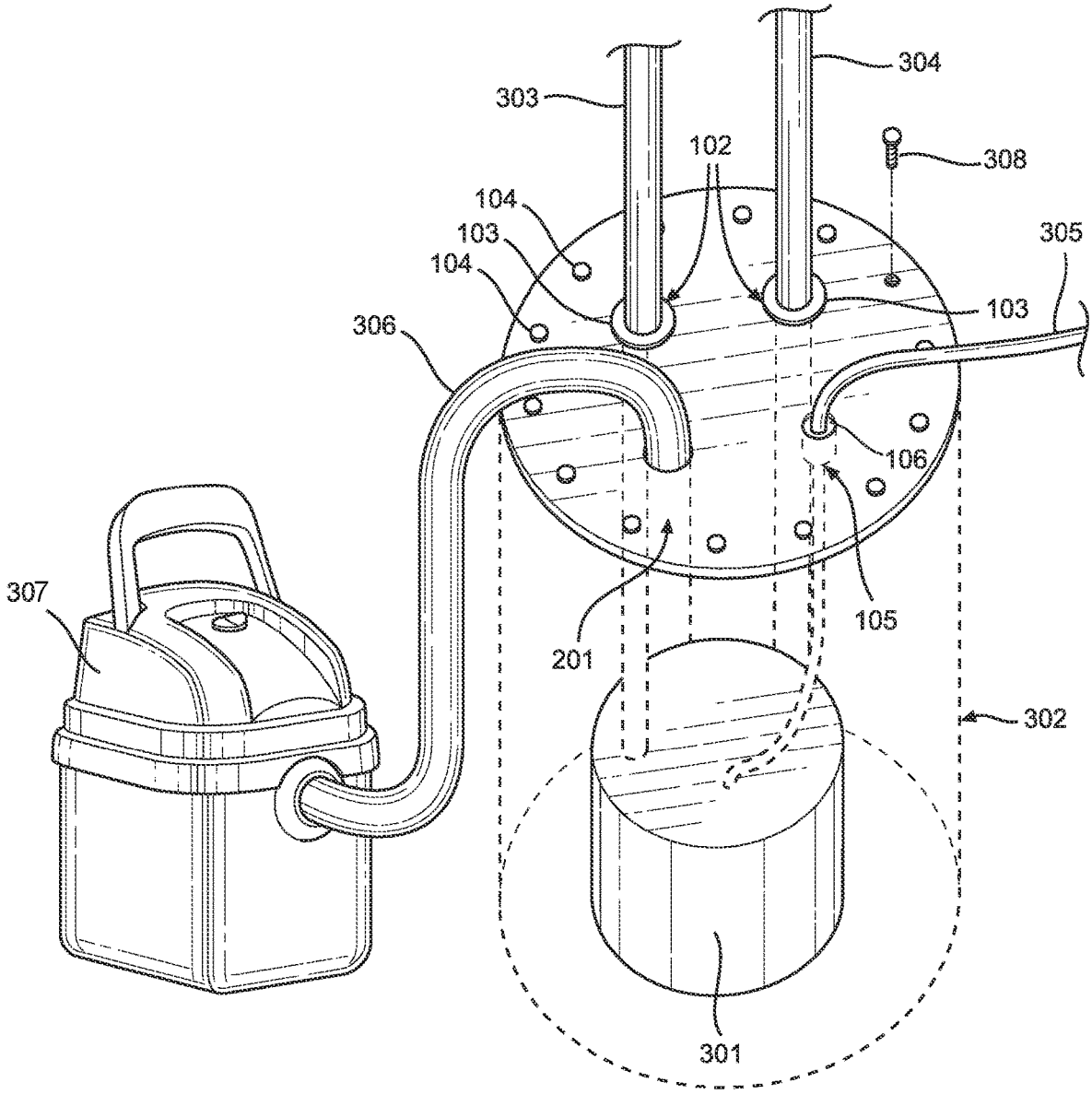
FIG. 3 shows a perspective view of an embodiment of the transparent sump pump tank cover in use.

Referring now to FIG. 3, there is shown a perspective view of an embodiment of the transparent sump pump tank cover in use. In operation, a sump pump 301 is placed within a pump hole, tank, or reservoir 302. The pump hole 302 will allow the sump pump 301 to below the surface of the floor. This will allow liquids to enter the pump hole 302 and activate the sump pump 301. There are a pair of pipes 303, 304 that are placed through the body 201 of the cover through the pair of apertures 102. In the shown embodiment, the pipes 303, 304 are placed through the gasket linings 103 such that they seal against the pipes. The first pipe 303 is a drainpipe. The first pipe 303 is connected to the sump pump 301 such that the sump pump 301 can pump liquids out of the pump hole 302. The second pipe 304 is a vent pipe. The second pipe 304 will prevent the buildup of pressure due to gases that form due to chemical reactions of the materials within the pump hole 302. The second pipe 304 will also prevent a vacuum effect when liquid is pumped from the pump hole 302.

An electrical cord 305 is placed through the third aperture 105. In the shown embodiment the electrical cord 305 is secured using the gasket 106 to maintain a secure connection and prevent leaks. The electrical cord 305 is connected to the sump pump 301 in order to provide power to the sump pump 301. The electrical cord 305 can include additional wiring for controlling the sump pump 301.

In the shown embodiment there is a vacuum hose 306 removably inserted within the fourth aperture 201. The plug has been removed to allow for the vacuum hose 306 to be placed therein. The vacuum hose 306 is then connected to a vacuum 307. This will allow for liquid to be removed from the pump hole 302 via the vacuum 307 without removing the transparent sump pump tank cover. Once enough liquid is removed, the user can inspect the interior workings of the sump pump system through the transparent cover.

In the shown embodiment the transparent sump pump tank cover is secured to the top of the pump hole 302 via a plurality of fasteners 308 placed within the plurality of apertures 104 of the body 101. In this embodiment the plurality of fasteners 308 are bolts. In other embodiments different fasteners 308 are used. In one embodiment the fasteners 308 are removable from the plurality of apertures 104. In another embodiment the fasteners 308 are secured within the plurality of apertures 104. In this way, the cover can still be removed if needed. However, the primary benefit of the present invention is the transparent body of the cover which allows individuals to examine the interior of the pump hole without removing the cover, as well as the vacuum hose aperture that allows users to remove material as needed on their own.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sump pump tank cover covering a sumo hole that collects liquid, comprising:

a body composed of a transparent material;

a first pair of apertures disposed on the cover and extending through the body, wherein each aperture of the pair of apertures is configured to receive a pipe therethrough;

a third aperture disposed on the cover and extending through the body, wherein the third aperture is configured to receive one or more electrical cords therethrough;

a fourth aperture disposed on the cover and extending through the body, wherein the fourth aperture is configured to receive a removable vacuum hose therethrough, the removable vacuum hose connected to a vacuum device having a motor that generates a B vacuum for suction removal of the liquid from a bottom of the sumo hole by the vacuum device, the fourth aperture configured to maintain a seal with and maintain a port for the removable vacuum hose; and a removable plug inserted into the fourth aperture when the fourth aperture is not currently in use.

2. The sump pump tank cover of claim 1, further comprising a plurality of fastener apertures dispose around a perimeter edge of the cover.

3. The sump pump tank cover of claim 2, further comprising a fastener located within each fastener aperture of the plurality of fastener apertures.

4. The sump pump tank cover of claim 1, further comprising a rubber gasket lining each aperture of the first pair of apertures, wherein each rubber gasket forms a seal against the pipe inserted through its respective aperture of the first pair of apertures.

5. The sump pump tank cover of claim 1, further comprising a sealable rubber gasket configured to seal against the one or more electrical cords when the one or more electrical cords are inserted through the third aperture.

6. The sump pump tank cover of claim 1, wherein the transparent material is a polycarbonate material.

7. The sump pump tank cover of claim 1, wherein the removable plug seals the fourth aperture when secured therein.

8. The sump pump tank cover of claim 1, wherein the third aperture includes a diameter that is less than a diameter of each aperture of the first pair of apertures.

9. The sump pump tank cover of claim 1, wherein the removable plug is composed of rubber.

* * * * *